US005821695A

United States Patent [19]

Vilanilam et al.

[11] Patent Number: 5,821,695

[45] Date of Patent: Oct. 13, 1998

[54] ENCAPSULATED EXPLOSION-PROOF PILOT LIGHT

[75] Inventors: Santosh Vilanilam, Hinsdale; Nabil L. Mina, Roselle, both of Ill.

[73] Assignee: Appleton Electric Company, Chicago, Ill.

[21] Appl. No.: 693,363

[22] Filed: Aug. 6, 1996

[51] Int. Cl.[6] ..... H01J 7/44

[52] U.S. Cl. ..... 315/58; 315/71; 362/800

[58] Field of Search ..... 315/56, 71, 58, 315/324; 362/800, 29; 439/375

[56] References Cited

U.S. PATENT DOCUMENTS

| | | | |
|---|---|---|---|
| 4,152,624 | 5/1979 | Knaebel | 313/499 |
| 4,712,163 | 12/1987 | Oxley | 362/800 |
| 4,725,759 | 2/1988 | Tachikawa | 315/51 |
| 4,727,289 | 2/1988 | Uchida | 313/500 |
| 4,939,426 | 7/1990 | Menard et al. | 315/51 |
| 5,113,329 | 5/1992 | Lin | 362/800 |
| 5,278,734 | 1/1994 | Ferber | 362/800 |

FOREIGN PATENT DOCUMENTS

| | | | |
|---|---|---|---|
| 402238680 | 9/1990 | Japan | 257/89 |

OTHER PUBLICATIONS

Sylgard 184 Silicone Elastomer, Base & Curling Agent, Information Brochure, 1991 Dow Corning Corporation.

Hubbell Killark Catalog; p. 27, Stahl Pilot Light, including sketch dated at least a year before the invention thereof by applicant.

*Primary Examiner*—Michael Shingleton

*Attorney, Agent, or Firm*—Jones, Day, Reavis & Pogue

[57] ABSTRACT

A housing having a cavity is in sealing engagement with a glass jewel which also contains a cavity; these two cavities cooperate to form a closed chamber. A frame supporting terminal plates is mounted within the chamber. The frame also mounts a circuit board which in turn mounts a plurality of LEDs. An encapsulating material fills all of the spaces within the chamber.

29 Claims, 4 Drawing Sheets

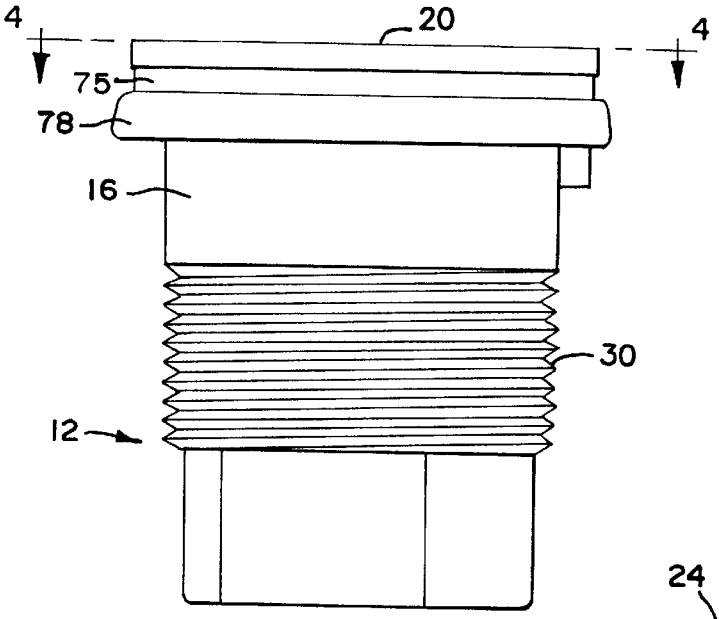
FIG. 3
FIG. 4
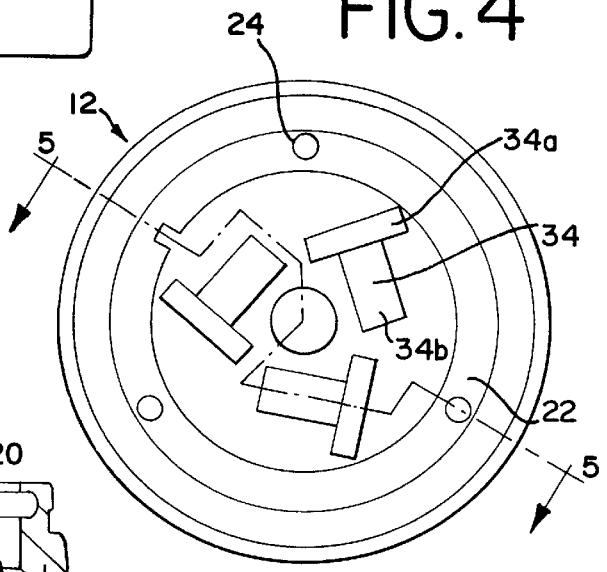
FIG. 5
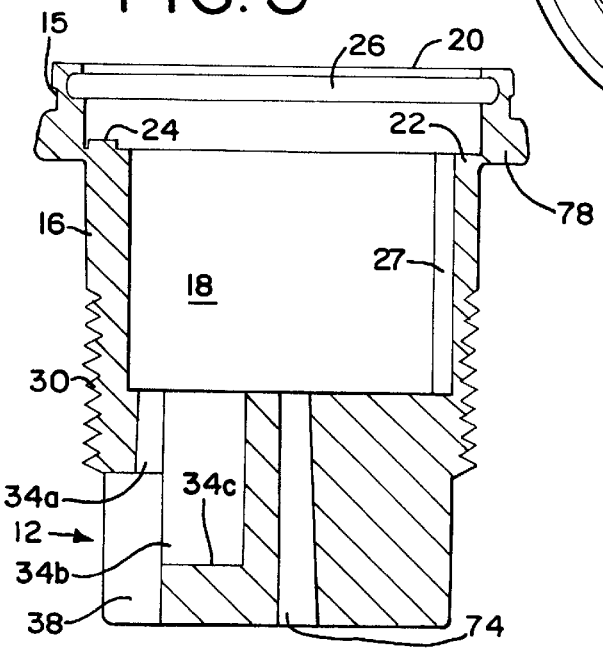

ENCAPSULATED EXPLOSION-PROOF PILOT LIGHT

The present invention relates to pilot (or indicator) lights. More particularly, the present invention relates to an encapsulated explosion-proof pilot (or indicator) light.

BACKGROUND OF THE INVENTION

Indicator lights, referred to in the electrical trade as pilot lights, are employed to visually indicate an electrical function that is being carried either at a remote or local area. Typically, these pilot lights are associated with push-buttons or selector switches. Pilot lights are also used together with instruments, gauges and meters, all mounted on a panel forming part of a control board.

Pilot lights of the type under consideration include one or more Light Emitting Diodes (LEDs) mounted in a housing assembly having a transparent portion such that the condition of the bulb or LED may be observed. The housings are normally sealed to protect the various electrical components since these pilot light assemblies are often located in damp, wet or corrosive environments. The sealed housing also permits these pilot lights to be used in areas which are hazardous due to the presence of flammable vapors, gases or highly combustible dusts. These pilot lights may be used indoors or outdoors in various locations, such as petroleum refineries, chemical and petrochemical plants and other process industry facilities where similar hazards exist.

SUMMARY AND OBJECTS OF THE INVENTION

The present invention provides a new and improved pilot (or indicator) light assembly.

A primary object of the present invention is the provision of a long-lasting plastic pilot light assembly that meets both International Electrotechnical Commission (IEC) standards and National Electrical Code (NEC) standards for electrical devices operating at atmospheric pressure in the presence of explosive gases, vapors or dusts.

Another object of the present invention is the provision of a pilot light assembly that may be operated at both 120 and 240 VAC.

Another object of the present invention is the provision of a pilot light assembly which can be made available in a variety of colors.

Yet another object of the present invention is the provision of a pilot light assembly which lends itself to relatively inexpensive manufacture and assembly.

Still another object of the present invention is the provision of a pilot light assembly which is disposable in nature due to its relatively inexpensive cost.

These and other objects and advantages of the invention will become apparent from the following specification disclosing a preferred embodiment.

DESCRIPTION OF THE DRAWINGS

FIG. 3 is a side elevational view of the housing forming part of the pilot light assembly;

FIG. 4 is a top plan view of the housing as seen taken along the line 4—4 of FIG. 3;

FIG. 5 is a section of the housing taken along the line 5—5 of FIG. 4;

DESCRIPTION OF A PREFERRED EMBODIMENT

Figure 1:
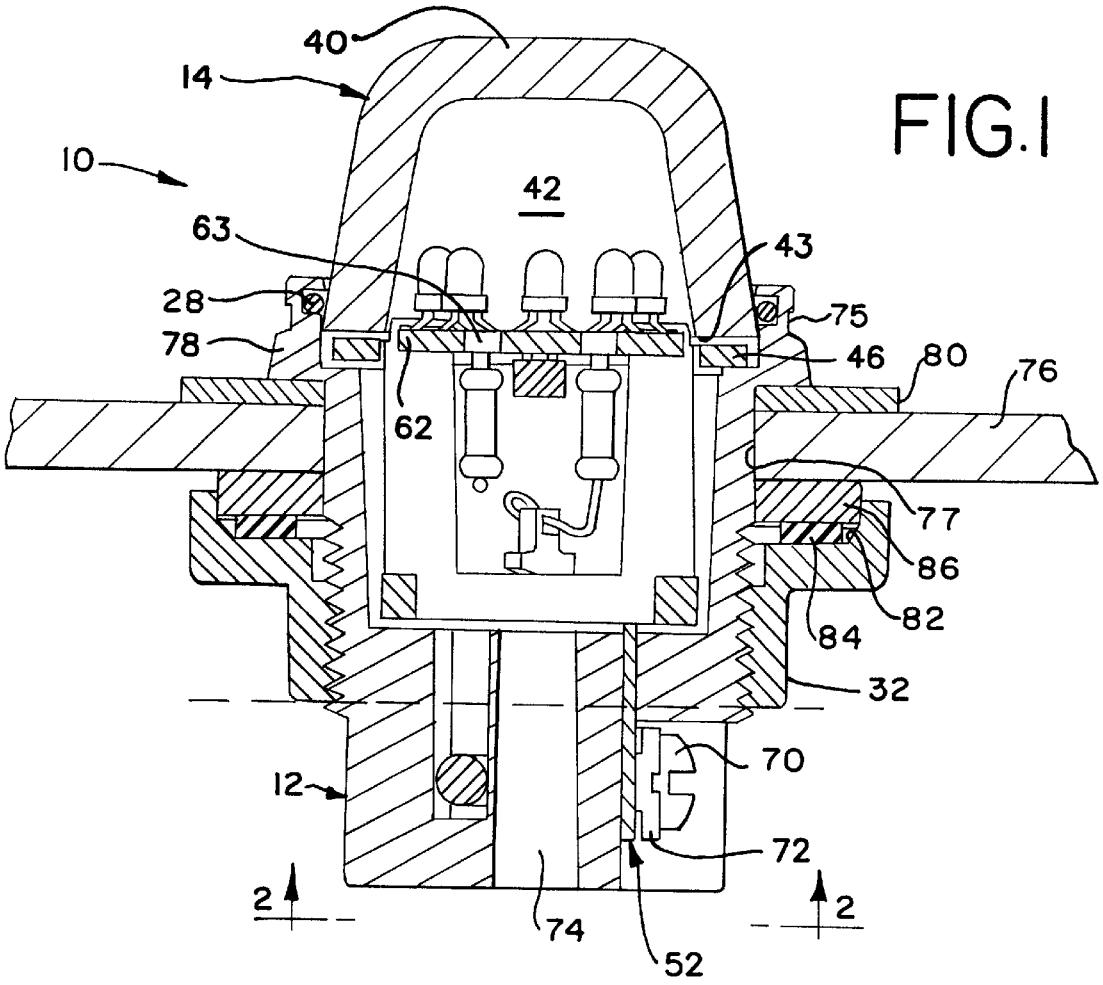
FIG. 1 is a vertical central section of the pilot light assembly.
Figure 2:
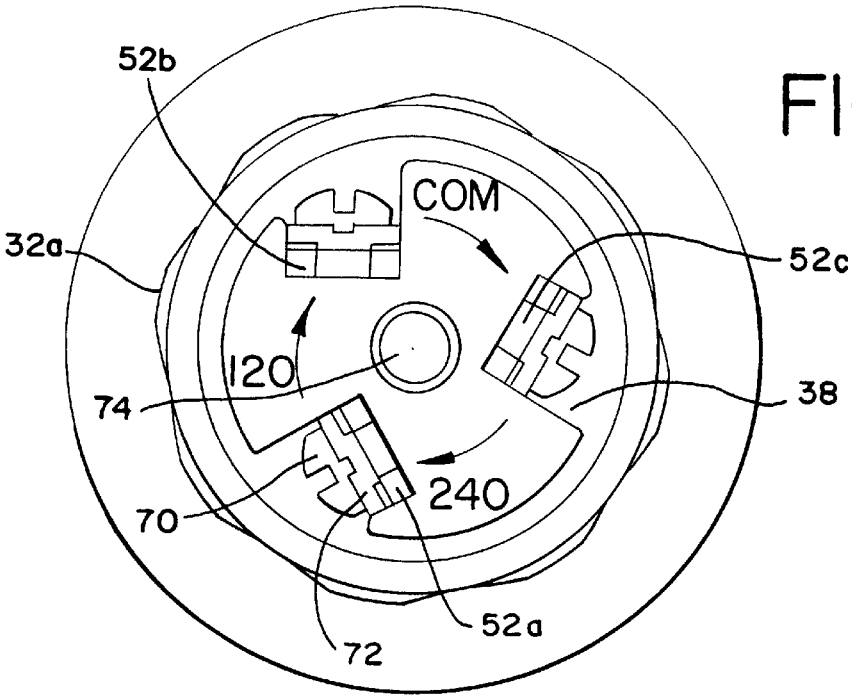
FIG. 2 is a bottom view of the pilot light assembly as seen taken along the line 2—2 of FIG. 1.

Referring particularly to FIGS. 1 and 2, the pilot light assembly, generally designated 10, will be seen to include a housing, generally designated 12. The pilot light assembly also includes a dome-like transparent member, generally designated 14.

Referring to FIGS. 3–5, the housing 12 is seen to include a cylindrical shell 16 forming a cavity 18. The housing is preferably formed from a suitable plastic material, such as Valox 420SEO, 7001 Black. The side wall of the cavity 18 is preferably frusto-conical in shape such that the diameter of the cavity 18 is larger at its upper portion. The shell 16 includes an upper enlarged annular portion 20 defining an annular ridge 22 interrupted by three projections 24. As noted from FIG. 4, the projections 24 are equally spaced on the ridge 22. The enlarged portion 20 of the housing shell 16 includes an annular recess 26 for receiving an O-ring 28 as seen in FIG. 1.

The housing shell 16 includes an outer annular threaded formation 30. The threads 30 are adapted for threading engagement with complimentary threads formed in the interior of a nut 32 as seen in FIG. 1.

The cavity 18 is in communication with three equally spaced T-shaped slots 34. Each T-shaped slot includes a first slot portion 34*a* and a second slot portion 34*b* as best seen in FIG. 5. Each slot portion 34*a* is in communication with a recess 38; each slot portion 34*b* terminates at a wall 34*c* as best seen in FIG. 5.

Referring to FIG. 1, the dome-like member 14 is preferably in the form of a glass jewel 40. Although the dome-like member 14 can be made of a transparent plastic material, the glass jewel is preferable in that it is suitable for an environment where chemical or salt water corrosion may be a concern. A snap-on guard (not shown) may be provided to protect the glass jewel. As is clear from FIG. 1, the O-ring 28 acts to form a seal between the glass jewel 40 and the housing 12.

This seal is necessary to prevent the encapsulating material, to be referred to below, from escaping the assembly and to prevent moisture ingress to the pilot light assembly. As an alternative to the O-ring 28, the glass jewel 40 may be sealed to the housing 12 by plastic welding techniques, such as ultrasonic, laser and hot plate welding. Establishing the seal by welding obviates the need for the O-ring and provides a positive mechanical connection between the glass jewel and the housing. However, a properly fitted O-ring 28 forming part of the embodiment of the present invention shown for purposes of illustration will provide an effective seal.

The glass jewel 40 defines a cavity 42 which is in communication with the cavity 18 in the housing 12; these two cavities cooperate to define a substantially closed chamber for receiving other components of the pilot light assembly to be referred to below.

Figure 6:
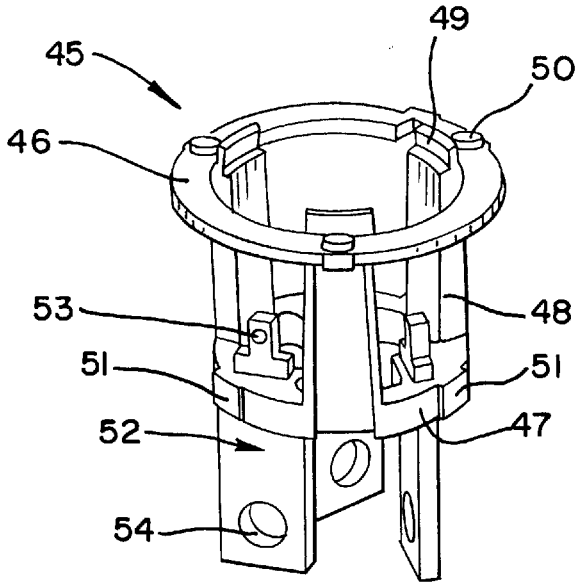
FIG. 6 is an isometric view of the frame forming part of the pilot light assembly.

Referring now primarily to FIG. 6, a frame, generally designated 45, is preferably of a one-piece molded construction formed of a suitable plastic material, such as Hytrel 7246, natural color. The frame 45 includes an upper annular member 46 and a lower annular member 47 joined together by three equally spaced legs 48. Each leg defines a notch or recess 49 at its upper end. The annular member includes three equally spaced cylindrical projections 50. It is noted that the outer diameter of the lower annular member 47 is less than the outer diameter of the upper annular member 46; this feature facilitates insertion of the frame 45 into the frusto-conical cavity 18 of the housing 12.

The lower annular member 47 of the frame includes three equally spaced slots each receiving a terminal plate 52. Each terminal plate 52 includes an upper eye 53 and a lower threaded opening 54.

Figure 7:
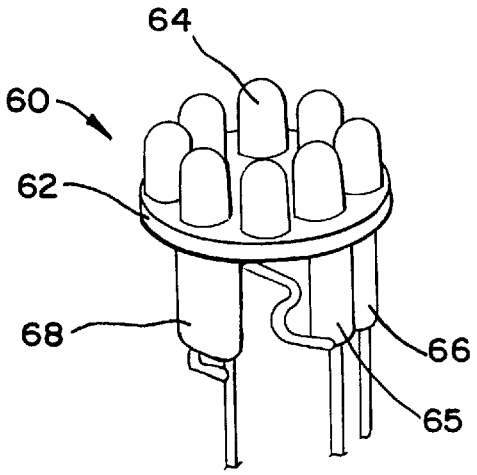
FIG. 7 is an isometric view of the circuit board and Light Emitting Diode cluster.

Referring now to FIG. 7, an indicator sub-assembly, generally designated 60, includes a disc-like circuit board 62 mounting a plurality of Light Emitting Diodes (LEDs) 64. The circuit board and the frame are designed to position the LEDs at optimum locations within the glass jewel such that an isotropic emission pattern will be observed. The circuit board 62 includes suitable printed circuit elements on its underside; the circuit board also mounts resistors 65 and 66 and a capacitor 68.

Figure 8:
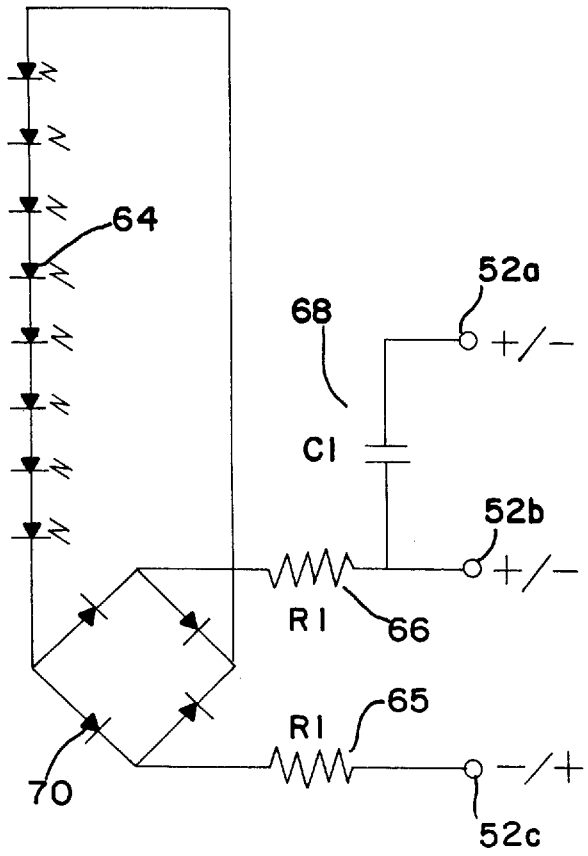
FIG. 8 is a circuit diagram of the pilot light assembly.

Referring to FIG. 8, the series arranged LEDs 64 are shown connected to a bridge rectifier including a plurality of diodes 70. Various circuit elements are connected by electrical leads to the terminal plates 52*a*, 52*b* and 52*c* as seen in FIGS. 2 and 8. It will be noted that the pilot light assembly can accommodate both 120 VAC and 240 VAC.

Referring to FIG. 6, it is seen that the lower annular member 47 of the frame 45 includes a plurality of equally spaced projections 51. These projections are dimensioned such that they will contact the lower inner wall portion of the cavity 18 and thus provide spacing between the lower annular member 47 and the interior wall of the cavity 18. The creation of these spaces facilitates encapsulation of the pilot light assembly to be referred to below.

The frame 45 facilitates modularized assembly of the pilot light components. In this respect, the LEDs 64 and the various resistors and capacitors are first secured to the circuit board 62. The circuit board is then snapped into place in the recesses 49 at the upper ends of the legs 48 of the frame 45. The plates 52 will be passed through the slot portions 34*a* formed in the bottom wall of the cavity 18. The electrical leads are next connected to the eyes 53 of the terminal plates 52. Frame 45 will then be inserted in the cavity 18 of the housing 12. When the frame is fully inserted in place, the underside of the upper annular member 46 will rest on the projections 24 on the upper end of the housing 12. The frame 45 is preferably provided with a projection (not shown) adapted to be received within the axially extending recess 27 (FIG. 5) formed in the side wall of the cavity 18. This projection and ridge facilitate positioning of the frame relative to the housing shell such that the terminal plates 52 will readily pass through the slot portions 34*a*.

Continuing the description of the assembly of the pilot light, screw-type threaded fasteners 70 are then threaded in the openings 54 of the terminal plates. Slot portions 34*b* will receive the ends of these fasteners permitting the fasteners to be fully turned for tightening washers 72 against terminal plates 52 as shown in FIG. 2. The terminal plates are connected to electrical wires (not shown) which supply power to the pilot light assembly. Accordingly, good electrical contact can be established between the source of power and the terminal plates 52.

The glass jewel 40 will then be snapped into place. A seal between the housing 12 and the glass jewel will be established by reason of the O-ring 28. An annular rim 43 (FIG. 1) of the glass jewel 40 will rest on the projections 50 on the upper surface of the upper annular member 46 of the frame 45.

It is noted that the housing 12 includes a bore 74 for communicating with the cavity 18. This bore is used to facilitate the introduction of an encapsulating material which will completely fill all of the open spaces in the chamber defined by the cavity housing 18 and the glass jewel cavity 42. The encapsulating material is preferably an elastomer, such as a silicone elastomer, Sylgard 184. The two-part silicone elastomer, Sylgard 184 from Dow Corning, is preferable for three primary reasons. First, this material is optically clear with a refractive index close to glass. Second, this material has sufficient thermal capability to reduce the surface temperatures of the assembly. Third, this material provides the capacity to absorb the impact tests that are listed in the IEC standards without cracking the glass jewel. Because of the various open spaces between the frame 45 and the chamber defined by the cavities 18 and 42, the elastomer material will readily flow throughout these cavities for completely filling all interior spaces. In this respect, the circuit board 62 is preferably provided with one or more openings 63 (FIG. 1) to facilitate the flow of the elastomer material.

FIG. 1 shows the pilot light assembly mounted to the wall 76 of an electrical control box. The wall 76 is provided with an opening 77 having a diameter just slightly in excess of the outer diameter of the housing shell 16. As best seen in FIG. 5, the housing 12 has a downwardly extending annular ledge 78 which will engage the wall 76. FIG. 1 shows an optional legend plate 80 which may be disposed between the wall 76 and the annular ledge 78.

The nut 32 includes an annular recess 82 adapted to receive a nylon bushing 84 and a gasket 86. As the nut 32 is tightened relative to the housing shell 16, a seal will be provided between the pilot light assembly and the opening 77 in the wall 76. In this respect, the nylon bushing 84 imposes uniform loading on the surface of the gasket 86, and as the nut 32 is turned, the bushing 84 forces the gasket 86 to hug the housing with equal compressive forces, providing an effective seal around the housing. The nut 32 is preferably provided with a hexagonal or octagonal formation 32*a* to facilitate tightening of the nut by means of a wrench.

The housing 12 may be provided with a key formation (not shown) to be received in a correspondingly shaped notch (not shown) in the opening 77 of the wall 76. The key and notch feature prevents the pilot light assembly from rotating relative to the electrical control box. Further, this key and notch feature facilitates positioning of the terminal plates 52 in their desired locations.

The glass jewel is preferably provided in three colors, such as green, red and amber. It has been found that assembling the LEDs within a glass housing of the same color, as opposed to assembling the LEDs in a clear glass housing, appears to enhance visually the light intensity of the LEDs. Thus, red LEDs should be provided if the glass jewel is red, for example.

Although a particular preferred embodiment of the invention has been disclosed in detail for illustrative purposes, it will be recognized that variations or modifications of the disclosed pilot light assembly lie within the scope of the present invention as defined by the following claims.

What is claimed is:

1. An encapsulated explosion-proof pilot light assembly comprising:

(a) a housing defining a first cavity open at one end of the housing and having a bore formed therein, said bore for receiving an encapsulating material;

(b) a dome-like transparent member mounted to said housing at said one end thereof and defining a second cavity in communication with the first cavity, said housing and said transparent member cooperating to form a substantially closed chamber consisting of said first and second cavities;

(c) a frame mounted substantially within said first cavity, said frame including upper and lower annular members having open centers that allows encapsulating material to pass therethrough, said upper and lower annular members joined in spaced apart relationship by a plurality of legs defining openings therebetween;

(d) a circuit board mounted to said frame adjacent said upper annular member;

(e) at least one LED device in a plurality of circuit elements mounted by said circuit board; and (f) an encapsulating material substantially filling all of the open spaces within said chamber.

2. The pilot light assembly according to claim 1 wherein said circuit board is circular in shape and is mounted in concentric relationship with said upper annular member, the diameter of said circuit board being less than the inside diameter of said upper annular member thereby defining a substantially annular opening between said circuit board and said upper annular member to facilitate the flow of encapsulating material.

3. The pilot light assembly according to claim 1 wherein said transparent member is a glass jewel.

4. The pilot light assembly according to claim 1 wherein said encapsulating material is a silicone elastomer.

5. The pilot light assembly according to claim 1 wherein said circuit board mounts a plurality of LED devices.

6. The pilot light assembly according to claim 5 wherein said transparent member and said LED devices are of the same color.

7. The pilot light assembly according to claim 1 wherein said frame has a plurality of openings to facilitate the flow of said encapsulating material.

8. The pilot light assembly according to claim 1 wherein said circuit board has at least one opening to facilitate the flow of said encapsulating material.

9. The pilot light assembly according to claim 1 wherein the encapsulating material provides good thermal conductivity, is optically clear and offers resistance to impact tests.

10. An apparatus as claimed in claim 1 including:

a projection connected to said upper annular member for supporting said transparent member.

11. An apparatus as claimed in claim 1 including:

a projection connected to said housing for supporting said frame.

12. An apparatus as claimed in claim 1 including:

a projection connected to said lower member of said frame for contacting a sidewall of said cavity of said housing.

13. An apparatus as claimed in claim 1 wherein:

said first cavity has a frusto-conical surrounding wall; and said lower annular member of said frame has a smaller diameter than the upper annular member of said frame.

14. An apparatus as claimed in claim 1 wherein:

said housing includes a plurality of T-shaped slots in communication with said cavity; and said circuit board includes at least one opening.

15. An apparatus as claimed in claim 1 wherein:

said housing has an outer threaded surface and an annular ledge; and including a nut adapted to be threadedly engaged to said housing whereby said nut and said annular ledge cooperate to attach said assembly to a wall;

a bushing; and a gasket whereby rotating said nut causes said bushing to force said gasket to bear against said housing.

16. An apparatus as claimed in claim 1 including:

electrically conductive plates mounted to the lower annular member of said frame.

17. An encapsulated-explosion proof pilot light assembly comprising:

(a) a generally cylindrical housing having an internal wall defining a first cavity at one end of the housing and having a bore formed therein, said bore for receiving an encapsulating material;

(b) a dome-like transparent member mounted to said housing at said one end thereof and defining a second cavity in communication with said first cavity, said housing and said transparent member cooperating to form a substantially closed chamber consisting of said first and second cavities;

(c) a frame including upper and lower annular members each having open centers that allows encapsulating material to pass therethrough, said upper and lower annular members joined in spaced apart relationship by a plurality of legs defining openings therebetween, the frame being mounted substantially within said first cavity and in concentric relationship therewith;

(d) a disc-like circuit board mounted to said frame adjacent said upper annular member and in concentric relationship therewith;

(e) at least one LED device in a plurality of circuit elements mounted by said circuit board; and (f) encapsulating material substantially filling all of the open space within said chamber.

18. The pilot light assembly according to claim 17 wherein said transparent member is a glass jewel.

19. The pilot light assembly according to claim 17 wherein said encapsulating material is a silicone elastomer.

20. The pilot light assembly according to claim 17 wherein said circuit board mounts a plurality of LED devices.

21. The pilot light assembly according to claim 20 wherein said transparent member and said LED devices are of the same color.

22. The pilot light assembly according to claim 17 wherein the encapsulating material provides good thermal conductivity, is optically clear and offers resistance to impact tests.

23. An apparatus as claimed in claim 17 including:

a projection connected to said upper annular member for supporting said transparent member.

24. An apparatus as claimed in claim 17 including:

a projection connected to said housing for supporting said frame.

25. An apparatus as claimed in claim 17 including:

a projection connected to said lower member of said frame for contacting a sidewall of said cavity of said housing.

26. An apparatus as claimed in claim 17 wherein:

said first cavity has a frusto-conical surrounding wall; and said lower annular member of said frame has a smaller diameter than the upper annular member of said frame.

27. An apparatus as claimed in claim 17 wherein:

said housing includes a plurality of T-shaped slots in communication with said cavity.

28. An apparatus as claimed in claim 17 wherein:

said housing has an outer threaded surface and an annular ledge; and including a nut adapted to be threadedly engaged to said housing whereby said nut and said annular ledge cooperate to attach said assembly to a wall;

a bushing; and a gasket whereby rotating said nut causes said bushing to force said gasket to bear against said housing.

29. An apparatus as claimed in claim 17 including:

electrically conductive plates mounted to the lower annular member of said frame.

* * * * *